US006625840B1

(12) United States Patent
Hansen et al.

(10) Patent No.: US 6,625,840 B1
(45) Date of Patent: Sep. 30, 2003

(54) SQUEEGEE APPARATUS HAVING EASILY REPLACEABLE BLADE MEMBER

(76) Inventors: Alan M. Hansen, 18304 SW. Westview Dr., Lake Oswego, OR (US) 97034; Dylan G. Ernst, 350405 SE. Clover Dr., Estacada, OR (US) 97023; Lance M. Lechner, 14400 Uplands Dr., Lake Oswego, OR (US) 97034

( * ) Notice: Subject to any disclaimer, the term of this patent is extended or adjusted under 35 U.S.C. 154(b) by 389 days.

(21) Appl. No.: 09/692,922

(22) Filed: Oct. 19, 2000

Related U.S. Application Data

(60) Provisional application No. 60/161,106, filed on Oct. 22, 1999.

(51) Int. Cl.[7] ..... A47L 13/11

(52) U.S. Cl. ..... 15/245; 15/250.41; 15/236.01

(58) Field of Search ..... 15/245, 250.41, 15/250.361, 236.06, 236.01, 236.02; 30/172, 329

(56) References Cited

U.S. PATENT DOCUMENTS

| | | | | | |
|---|---|---|---|---|---|
| 3,766,591 | A | * | 10/1973 | Soito | 15/245 |
| 5,101,530 | A | * | 4/1992 | Hansen et al. | 15/245 |
| 5,349,716 | A | * | 9/1994 | Millar | 15/245 |
| 5,666,685 | A | * | 9/1997 | von Grolman et al. | 15/121 |

* cited by examiner

*Primary Examiner*—Robert J. Warden, Sr.
*Assistant Examiner*—Shay L Balsis
(74) *Attorney, Agent, or Firm*—Olson & Olson

(57) ABSTRACT

An ergonomically-designed squeegee apparatus utilizes a substantially T-shaped body formed of a pair of hollow tube members, the laterally-extending tube member of the "T" frictionally mounting an easily removable and replaceable wiper blade member in substantially snap-fit engagement in an axial mounting slot, the longitudinally extending tube member of the "T" forming an arcuately curved handle member arranged for a comfortable and natural grasp by the hand of a user when the wiper blade member is positioned correctly for squeegeeing operations.

4 Claims, 2 Drawing Sheets

SQUEEGEE APPARATUS HAVING EASILY REPLACEABLE BLADE MEMBER

This application claims benefit under 35 U.S.C. 119(e) of the priority filing date of U.S. Provisional application Ser. No. 60/161,106 filed Oct. 22, 1999.

BACKGROUND OF THE INVENTION

This invention relates to squeegees, and more particularly to a simplified, more ergonomic squeegee construction having an easily replaceable blade member, as illustrated herein in the drawings of a preferred form of the invention.

As most people familiar with squeegees are aware, squeegees in the marketplace typically comprise a substantially "T-shaped", flat body in which a rubber squeegee blade is mounted for support at a 90° angle relative to a handle member, both the blade and the handle member of the body being contained in substantially the same, generally flat plane. In these constructions, an elongated rubber squeegee blade is typically clamped onto a supporting body member by screws and clamp plate members along its length, resulting in a rather complex and expensive assembly of parts to be constructed and put together and manufactured. Further, because of this involved assembly of parts, the replacement of the rubber squeegee blades by the end purchaser involves an actual disassembly and reassembly process in unclamping and removing the old blade and re-clamping a new blade properly in place. Consequently, it is not uncommon that users, particularly non professionals who only occasionally use their squeegees, use their squeegees with old, worn and even damaged blades and accept an inferior result or simply discard the entire tool and replace it new rather than go through the cumbersome procedure of attempting to properly replace the blade.

Clearly therefore, a need exists in the marketplace for a more "user-friendly" squeegee apparatus that permits even the most casual user of squeegees to easily and conveniently and quickly replace worn or damaged squeegee blades rather than replace the entire appliance out of frustration.

SUMMARY OF THE INVENTION

In its basic concept this invention provides a squeegee apparatus having a substantially unitary squeegee body formed as a laterally elongated tube member mounting a rearwardly extending, arcuately curved handle member, the laterally extending tube member having a forwardly disposed, laterally extending slot therethrough configured to receive and releasably secure a squeegee wiper blade member in frictional, snap-fit tight engagement.

It is by virtue of the foregoing basic concept that the principal objective of this invention is achieved; namely, the provision of a squeegee apparatus that positively and securely mounts a wiper blade operatively for use but also permits quick and easy removal and replacement of the wiper blade member without need of any tools, thereby overcoming the limitations and disadvantages of squeegee devices of the prior art.

Another object and advantage of this invention is the provision of a squeegee apparatus of the class described which is of simplified construction for economical manufacture.

Another object and advantage of this invention is the provision of a squeegee apparatus of the class described which is ergonomically configured to provide a more natural and comfortable grasp for the user when the wiper blade member is in proper, operative contact with the work surface.

A further object and advantage of this invention is the provision of a squeegee apparatus of the class described which may interchangeably receive wiper blades of different lengths as may be desired or needed for various squeegee functions.

A still further object and advantage of this invention is the provision of a squeegee apparatus of the class described which may be quickly and easily mounted on a handle extension member or pole for increased operational range and reach of the squeegee apparatus.

The foregoing and other objects and advantages of the present invention will appear from the following description of a preferred embodiment, taken in connection with the accompanying drawings of a preferred embodiment.

DESCRIPTION OF THE PREFERRED EMBODIMENT

Figure 1:
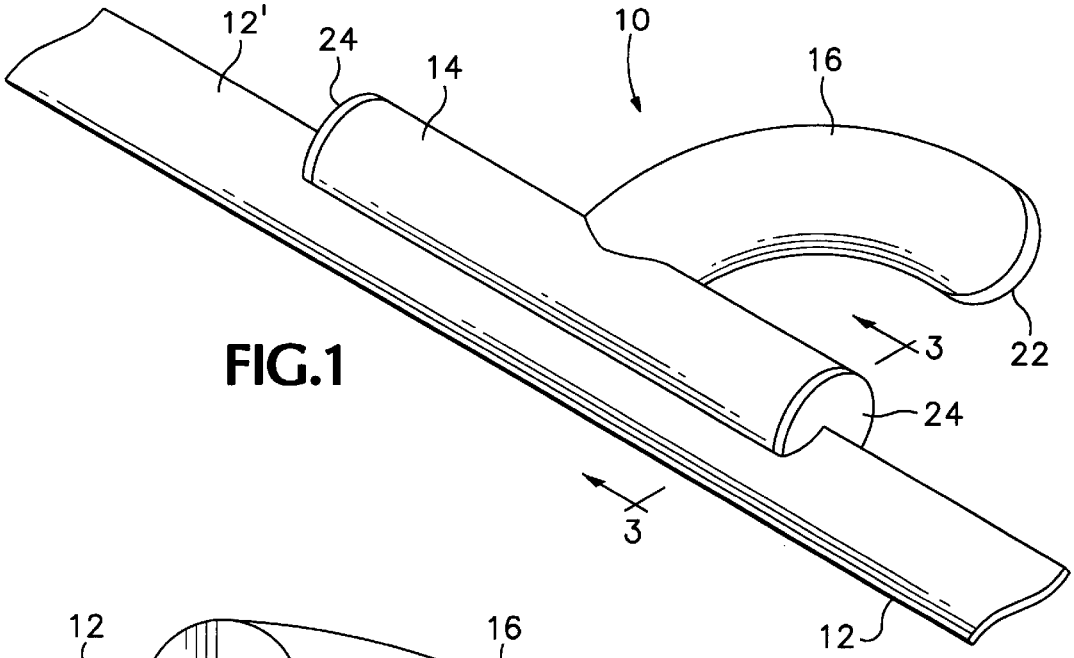
FIG. 1 is a perspective view of a squeegee apparatus embodying the features of this invention, the squeegee construction being illustrated herein as configured to utilize a curved wiper blade member such as those disclosed in earlier U.S. Pat. Nos. 5,074,027 and 5,101,530.

A squeegee 10 embodying features of this invention is illustrated in a preferred form in FIGS. 1–5 of the drawings. As will readily be apparent at the outset, the squeegee of this invention utilizes an extremely simple construction having a minimum of parts to manufacture and assemble, and provides the end user a tool having a blade element 12 which is easily and quickly replaceable without need of tools, etc.

As shown, the substantially unitary squeegee body member 10 essentially comprises a laterally extending, elongated tube member 14 and a rearwardly projecting, preferably arcuately curved handle member 16, together forming a generally T-shaped unit. As will be evident to those skilled in the art, the body member 10 may be formed in any suitable manner in any desired, suitable material such as metal, thermoplastic resin, etc. and in any relative dimensional proportions as may be desired and advantageous for various end use requirements. In the present preferred form of the invention, the body member is formed of molded polypropylene plastic and provided as a single, unitary piece.

The wiper blade member 12, the basic construction of which was previously disclosed in the aforementioned patents, includes a heel portion or securement portion 12' that is substantially rigid along its length for positive engagement by the body member 10, and a softer, flexible wiper blade portion along its leading edge.

Figure 3:
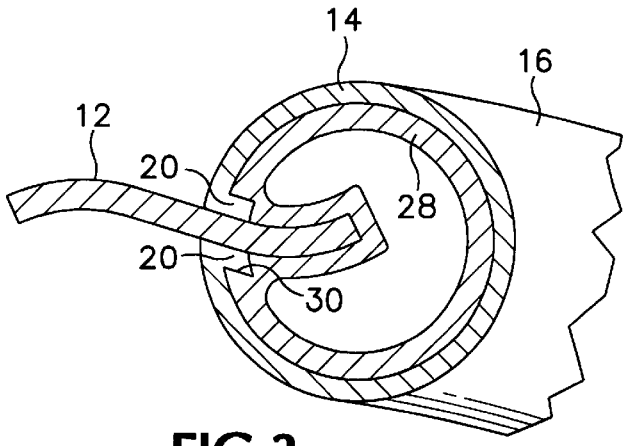
FIG. 3 is a fragmentary sectional view of the squeegee of FIG. 1 taken along the line 3—3 in FIG. 1.
Figure 4:
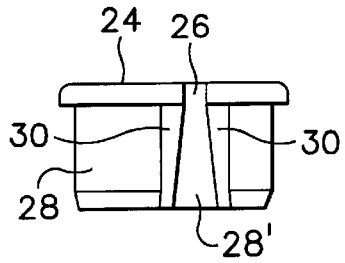
FIG. 4 is a fragmentary perspective view showing the internal configuration of the lateral tube member and associated end cap in an exploded, pre-installed condition.
Figure 4:
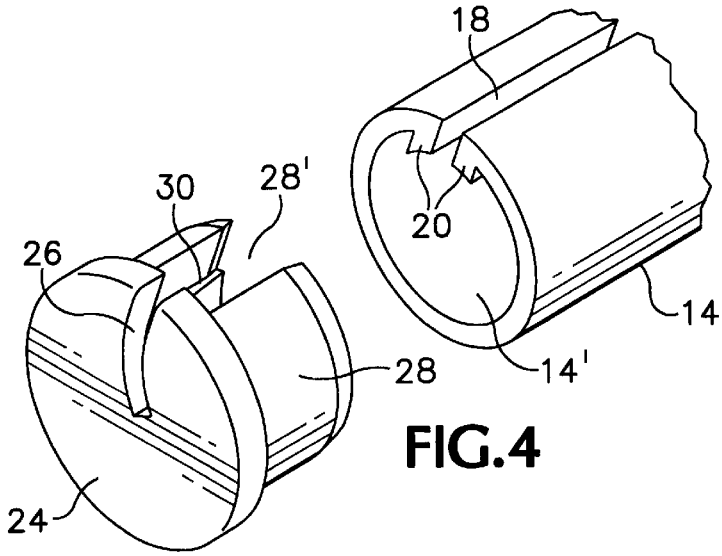
Figure 5:
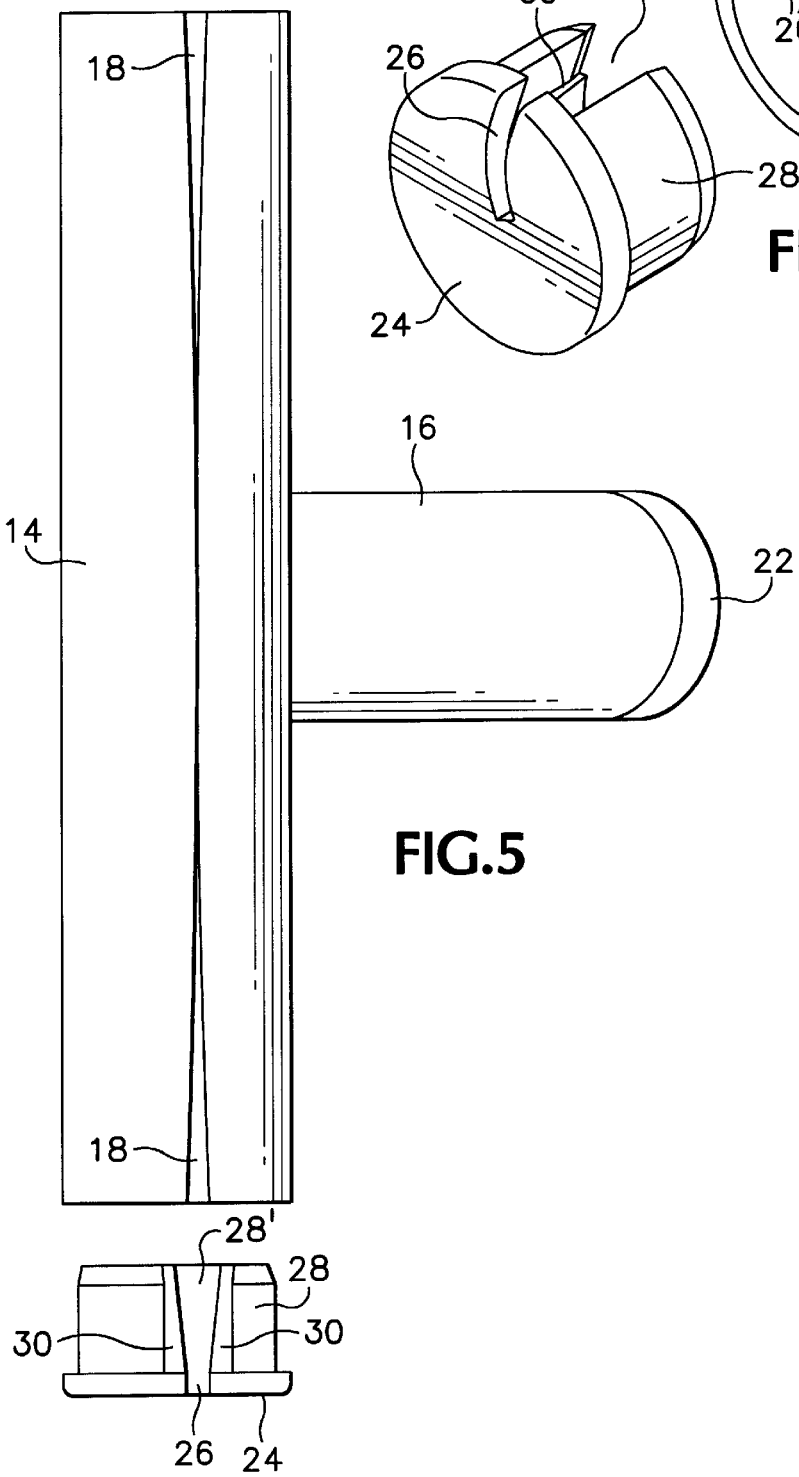
FIG. 5 is a front elevation of the squeegee member of FIG. 1 prior to assembly of the end caps and snap fit installation of the blade member onto the squeegee body.

Further to the above general overview of the basic construction of the body member 10, it will be readily apparent from the drawings that the laterally extending tube member 14 is configured at manufacture to include and provide a forwardly disposed, laterally extending open wiper blade-receiving slot 18 extending the length of the tube between its opposite open ends, as seen most clearly in FIGS. 4 and 5 of the drawings. As shown in FIGS. 3 and 4, the slot 18 may be formed, as in the preferred embodiment illustrated, with inwardly projecting flange members 20 provided along the confronting edges of the slot 18 and extending into the hollow interior of the tube member 14, the flanges serving to provide means for further rigidifying the slot 18 as well as providing means for supporting the wiper blade member positively in the tube member.

Means is provided to close the open ends of the tube members 14, 16 forming the body member 10, as for example by the end cap members 22, 24 shown. The end cap 22 closing the terminal end of the handle member 16 is preferably a removable cap member for reasons which will become clear later.

As is apparent in the drawings, end caps 24 close the opposite, open ends of the tube member 14 and include a radially extending slot 26 therein configured for corresponding alignment with the slot 18 in the tube member 14 when the end caps are installed thereon. This also provides support means associated with the slot 18 for rigidifying the slot and for engaging the heel portion 12' or securement portion of the wiper blade member and supporting it positively against unintended movement in the slot during normal use of the squeegee. In the preferred embodiment illustrated, this slot 26 has a curved configuration that matingly receives the heel portion 12' of the wiper blade member 12 disclosed in the aforementioned patent. It will be obvious to those skilled in the art that variations in the configuration of the wiper blade to be installed will require corresponding variations in the configuration of the slot 26.

As mentioned, the end caps 24 are preferably configured for a tight, frictional press-fit mount in the tube 14, and therefore the end caps include a projecting, annular mounting ring portion 28 having an external diameter and surface configuration arranged for frictional, mating engagement with the interior surface wall 14' of the tube member 14 as is apparent in FIGS. 3, 4 and 5 of the drawings. This annular mounting ring portion 28 also includes a cutout portion 28' aligned with the slot 26 for reception of the heel portion 12' of the elongated wiper blade 12.

For additional frictional contact and for positive alignment of the slot 26 with the slot 18, the end cap members 24 are further configured, as seen in the drawings and in particular FIG. 3 of the drawings, with corresponding notch portions 30 arranged to frictionally and matingly engage the inwardly projecting flanges 20 in tight, positive engagement. Aside from providing a more positive frictional mounting engagement between the tube members 14 and end caps 24, this arrangement further rigidifies the tube member at its opposite ends to securely and positively maintain the opening of the slot 18 at its proper, predetermined width for secure but releasable holding of the wiper blade member.

Preferably the installed wiper blade member is frictionally held along the entire length of the tube 14, and to this end, the slot 18 is preferably configured with an inward taper as seen best in FIG. 5. When the blade member is inserted into the slot, the tapered configuration of the slot assures both a positive frictional engagement of the blade member across the tube member and a positive, supporting engagement of the blade.

The foregoing squeegee construction thus described is preferred for its simplicity of manufacture and corresponding low manufacturing cost. Moreover, this preferred construction eliminates the need for the use of chemical bonding agents for securement of the end caps and the related equipment and assembly costs associated therewith. This, importantly, obviates worker exposure to the hazards and ill-effects of the chemical fumes associated with such agents in the manufacture of the squeegee.

Figure 2:
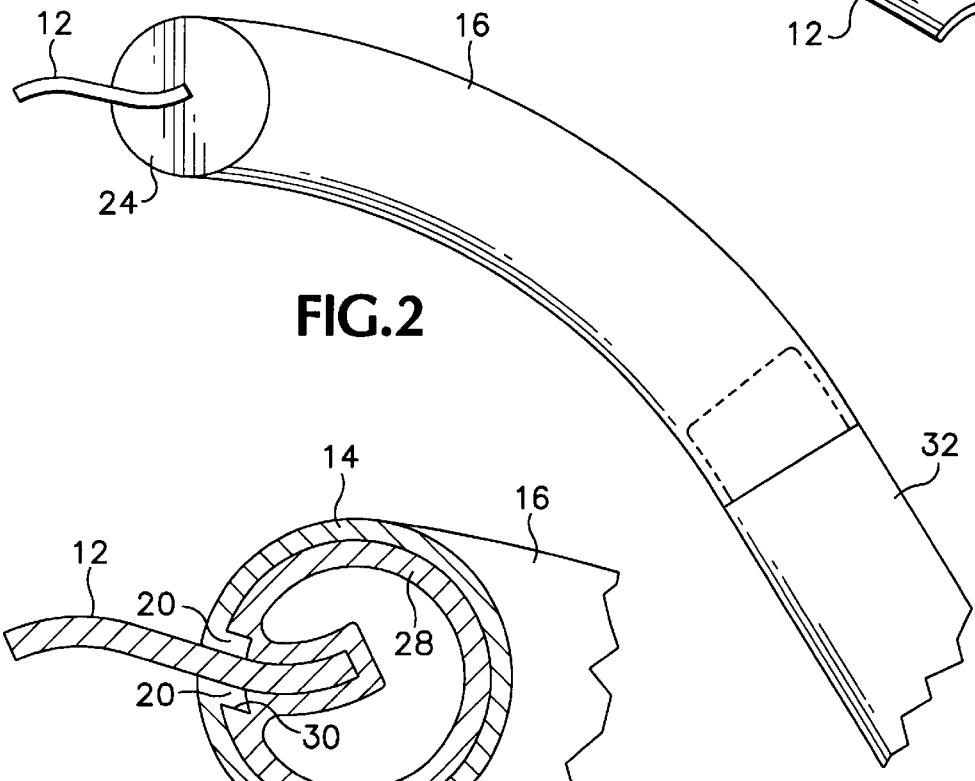
FIG. 2 is a fragmentary side view of the squeegee of FIG. 1 further illustrating the squeegee removably mounted on an extension pole member.

As will be appreciated in viewing the various drawings, the squeegee of the present invention is configured and arranged so that its curved handle member 16 is positioned and disposed on the lateral tube member 14 so that in use, when the squeegee blade is operatively positioned against a work surface, the handle member is positioned in an ergonomically-correct condition for comfortable and natural grasping in the hand of a user. As indicated in FIG. 2 of the drawings, the handle end cap member 22 may be removed for releasable installation of a handle extension member 32 for increased operational reach.

From the foregoing it will be apparent to those skilled in the art that various changes, other than those already described, can be made in the size, shape, type, number and arrangement of parts described hereinbefore without departing from the spirit of this invention and the scope of the appended claims. Having thus described my invention and the manner in which it may be used, I claim:

What is claimed is:

1. A generally T-shaped squeegee apparatus having an easily-replaceable wiper blade member, the squeegee apparatus comprising:

a) a unitary, substantially T-shaped body comprising a longitudinally elongated hollow tube member terminating in opposite, open, longitudinal terminal ends and having an integrally-formed, permanent elongated handgrip handle member projecting substantially perpendicularly from the tube member intermediate said opposite terminal ends, the elongated hand grip handle member terminating in an outer, free terminal end, b) the tube member also having a longitudinally extending axial slot along its entire length between said opposite, open terminal longitudinal ends, the slot forming an elongated slot opening through the tube wall defined between a pair of spaced-apart, longitudinally-extending confronting slot edges, each said confronting slot edge having a corresponding, longitudinally extending, confronting slot-rigidifying flange member extending along its length and projecting inwardly into the hollow interior of the tube member, the separate, spaced-apart confronting flange members forming, together with said confronting slot edges and said slot opening, an elongated open channel communicating said slot openings with the hollow interior of the tube member along the entire length of the tube member, c) a longitudinally elongated squeegee wiper blade member comprising a first, longitudinal, flexible wiper blade edge portion and a second, longitudinal, generally rigid securement portion, said second securement portion configured for removable reception within said slot in said tube member, and d) flange tensioning means associated with each said opposite terminal end of the tube member for frictionally interengaging the corresponding longitudinal end portions of said spaced apart, confronting flange members and tensioning the confronting flange members and said corresponding confronting slot edges toward each other into tensioned, substantially clamping engagement with said securement portion of the wiper blade member extending into the hollow interior of the tube member to secure said securement portion in substantially clamped condition on the tube member for squeegeeing operation and for permitting release and removal of the wiper blade member from the tube member under a predetermined, removal pulling force applied to the wiper blade member.

2. The squeegee apparatus of claim 1 wherein said blade securing means comprises a pair of end caps closing the opposite terminal ends of the tube member, each said end cap having a radially extending slot therein arranged for corresponding alignment with said axial slot in the tube member, each said end cap further configured with a projecting annular mounting ring portion arranged for frictional, press-fitted mounting engagement with the interior surface wall of the hollow tube member, each said annular mounting ring portion including a cutout portion formed as an inwardly tapered notch configured to frictionally receive and tensionably engage the outer terminal end portions of said spaced-apart confronting flange members in substantially wedging interengagement, tensioning said flange members toward each other into tight, frictional, substantially clamping engagement with the securement portion of the wiper blade member.

3. The squeegee apparatus of claim 1 wherein said elongated handle member is arcuately curved along its length extending from said tube member in a direction substantially perpendicular to the plane of a wiper blade member contained in the axial slot of the tube member.

4. The squeegee apparatus of claim 3 wherein said outer terminal end of the handle member is configured to releasably mount an end of an extension pole member for extended, operative reach of the squeegee apparatus by a user.

* * * * *